US008794481B2

(12) United States Patent
Abrahamsson

(10) Patent No.: US 8,794,481 B2
(45) Date of Patent: Aug. 5, 2014

(54) PACKAGE

(75) Inventors: Bertil Abrahamsson, Mullsjo (SE); Catharina Abrahamsson, legal representative, Mullsjö (SE); Claes Abrahamsson, legal representative, Jönköping (SE)

(73) Assignee: Superfos A/S, Taastrup (DK)

( * ) Notice: Subject to any disclaimer, the term of this patent is extended or adjusted under 35 U.S.C. 154(b) by 0 days.

(21) Appl. No.: 12/737,233

(22) PCT Filed: Jun. 23, 2009

(86) PCT No.: PCT/EP2009/057821

§ 371 (c)(1),
(2), (4) Date: Apr. 18, 2011

(87) PCT Pub. No.: WO2009/156401

PCT Pub. Date: Dec. 30, 2009

(65) Prior Publication Data

US 2011/0192860 A1 Aug. 11, 2011

(30) Foreign Application Priority Data

Jun. 23, 2008 (EP) ..... 08158750

(51) Int. Cl.
*B65D 41/18* (2006.01)
*B65D 39/04* (2006.01)

(52) U.S. Cl.
CPC ..... *B65D 39/04* (2013.01); *B65D 2543/00296* (2013.01); *B65D 2517/0013* (2013.01)
USPC ..... 220/793; 220/805; 220/260

(58) Field of Classification Search
USPC ..... 220/793, 805, 359.2, 796, 797, 780, 220/781, 783; 206/499, 503, 504, 508, 509
See application file for complete search history.

(56) References Cited

U.S. PATENT DOCUMENTS 5,762,231 A * 6/1998 Rider et al. ..... 220/526
5,810,197 A 9/1998 Mazzarolo (Continued)

FOREIGN PATENT DOCUMENTS

| | | |
|---|---|---|
| DE | 9103378 | 8/1991 |
| FR | 2733738 | 11/1996 |
| FR | 2791036 | 9/2000 |
| GB | 1264811 | 2/1972 |

OTHER PUBLICATIONS

English Abstract of FR 2733738.
English Abstract of FR 2791036.

*Primary Examiner* — Robert J Hicks
*Assistant Examiner* — Kareen Rush
(74) *Attorney, Agent, or Firm* — Dykema Gossett PLLC

(57) ABSTRACT

A lid that can be sealed to a container to provide packaging includes an edge with a pull tab which facilitates removal of the lid from the container. The lid and pull tab are injection molded integrally, and the pull tab has the form of a flexible grid-like flap that is bendable to a substantially upright position. The pull tab is formed by a number of spaced, parallel and interconnected bars that extend in a direction substantially at right angles to the direction of pulling of the pull tab.

8 Claims, 2 Drawing Sheets

(56) References Cited

U.S. PATENT DOCUMENTS 6,047,852 A * 4/2000 Evans et al. ..... 220/793
D427,525 S * 7/2000 Hayes et al. ..... D9/761
7,118,003 B2 * 10/2006 Sellari et al. ..... 220/266
2006/0032858 A1 * 2/2006 Lee et al. ..... 220/793
2008/0035641 A1 * 2/2008 Foldesi et al. ..... 220/276
2008/0073368 A1 * 3/2008 Custer et al. ..... 220/793

* cited by examiner

PACKAGE

BACKGROUND OF THE INVENTION

1. Field of the Invention

The present invention relates to a packaging comprising a container and a lid that can be sealed to the container, an edge of the lid being provided with a pull tab facilitating the removal of the lid from the container, and the lid and pull tab being injection moulded integrally.

2. The Prior Art

It is a well-known problem in packaging of this kind that the pull tab may interfere with other packages when stacking the packages beside each other or that the pull tab may be too weak or difficult to grip in order to lift a lid that is well sealed to the container.

The object of the present invention is to provide a packaging having improved properties in these aspects.

SUMMARY OF THE INVENTION

In view of this object, the packaging is characterized in that the pull tab has the form of a flexible grid-like flap that is bendable to a substantially upright position, and the pull tab is formed by a number of spaced, parallel and interconnected bars that extend in a direction substantially at right angles to the direction of pulling of the pull tab.

In this way, the flexible structure of the flap means that the flap may easily bend away if other packages are stacked next to the flap, and the grid-like structure of the flap may ensure a good friction when gripping the pull tab by means of the fingers and pulling in the pull direction. Furthermore, because of the grid-like structure, the flap may be provided with sufficient strength in the pull direction while at the same time being flexible. As the pull tab is able to bend to a substantially upright position, the pulling force may be utilized optimally for removing the lid from the container, even if the sealing force between the lid and the container should be rather large.

In an embodiment, the pull tab is connected to the lid along a bevelled corner of the lid. Thereby, it may even better be prevented that the pull tab interferes with other packages stacked nearby, as the pull tab may form part of a rectangle or square form of the lid.

In an embodiment, the pull tab, in its relaxed state, forms an angle of approximately 45 degrees with a general plane of the lid. Thereby, the pull tab may even better be kept away from nearby located packages, or the pull tab may be larger without interfering with other packages.

In an embodiment, neighbouring bars are interconnected by means of at least two, and preferably three, separate ribs that are thinner than the bars in the normal direction to the plane of the pull tab. Thereby, as a result of the thin material of the separate ribs, good flexibility of the pull tab may be obtained when bending the pull tab about an axis parallel to the bars.

In an embodiment, the length of the bars is decreasing in a direction away from the lid. Thereby, the risk of interference with nearby stacked packages may be minimized. Furthermore, the user is urged to grip at the middle of the pull tab, thereby avoiding loading the pull tab excessively at its edges, whereby the pull tab could break.

In an embodiment, the lid is made with a sealing zone for joining directly with the container. Thereby, a solid connection and sealing between the lid and the container may be obtained, while the flexible grid-like flap ensures that the lid is, at the same time, easy to remove from the container.

BRIEF DESCRIPTION OF THE DRAWINGS

The invention will now be explained in more detail below by means of examples of embodiments with reference to the attached very schematic drawings, in which.

DETAILED DESCRIPTION OF THE PREFERRED EMBODIMENT

Figure 1:
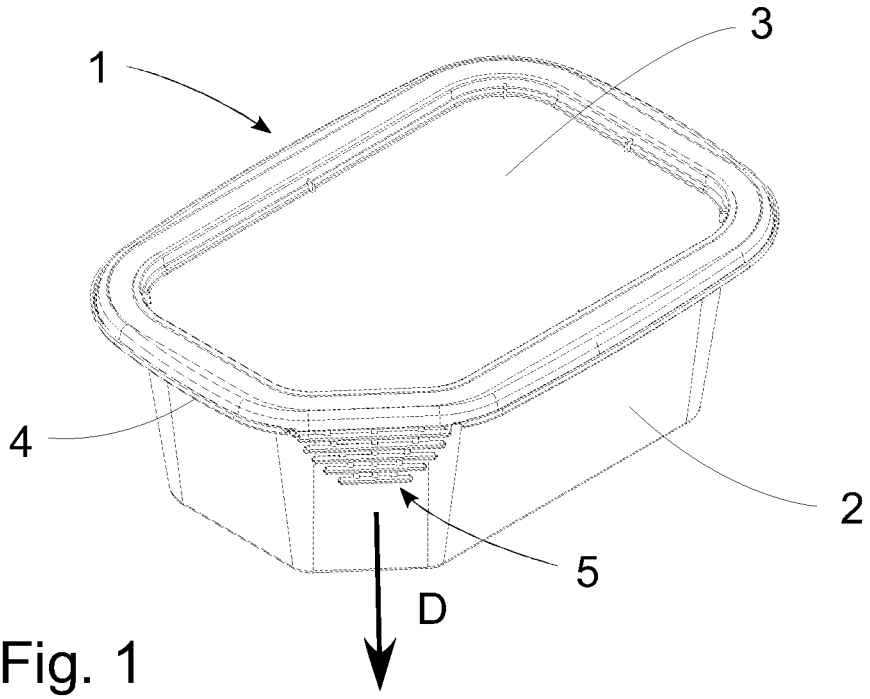
FIG. 1 is a perspective view of a packaging according to the invention, seen from above.

FIG. 1 is shows a packaging 1 according to the invention. The packaging 1 comprises a container 2 and a lid 3 that can be sealed to the container 1. Such packaging is in itself well-known for storing various products, such as, for instance, soft dairy products or the like. The container 2 may be injection moulded or for instance folded from a piece of cardboard and possibly provided with an inside injection moulded tub.

An edge 4 of the lid 3 is provided with a pull tab 5 facilitating the removal of the lid from the container. The lid 3 and pull tab 5 are injection moulded integrally, and the pull tab 5 has the form of a flexible grid-like flap that is bendable to a substantially upright position, so that the lid 3 may be removed from the container 2 by gripping the pull tab 5 between the fingers and thereby lifting the lid 3.

The pull tab 5 is connected to the lid 3 along a bevelled corner 6 of the lid and is at this connection bent in a downward direction, so that in its relaxed state, it forms an angle of approximately 45 degrees with a general plane of the lid 3. However, the pull tab 5 may be provided at any suitable place along the edge 4 of the lid 3.

The pull tab 5 is formed by a number of spaced, parallel and interconnected bars 7 that extend in a direction substantially at right angles to the direction (D) of pulling of the pull tab (perpendicular to the edge of the lid where the pull tab is connected, see FIG. 1, in which the direction (D) of pulling is indicated in relation to the pull tab in its relaxed state. However, when pulling the pull tab 5, the tab will be bent to an upright position, so that the direction of pulling also will be upward. Neighbouring bars 7 of the pull tab 5 are interconnected by means of three separate ribs 8 that are thinner than the bars 7 in the normal direction to the plane of the pull tab, thereby providing flexibility to the pull tab. The length of the bars 7 decreases in a direction away from the lid. The innermost bar 7 is connected to the edge 4 of the lid 3 by means of three separate ribs 8 in the same way as the bars are interconnected.

Figure 2:
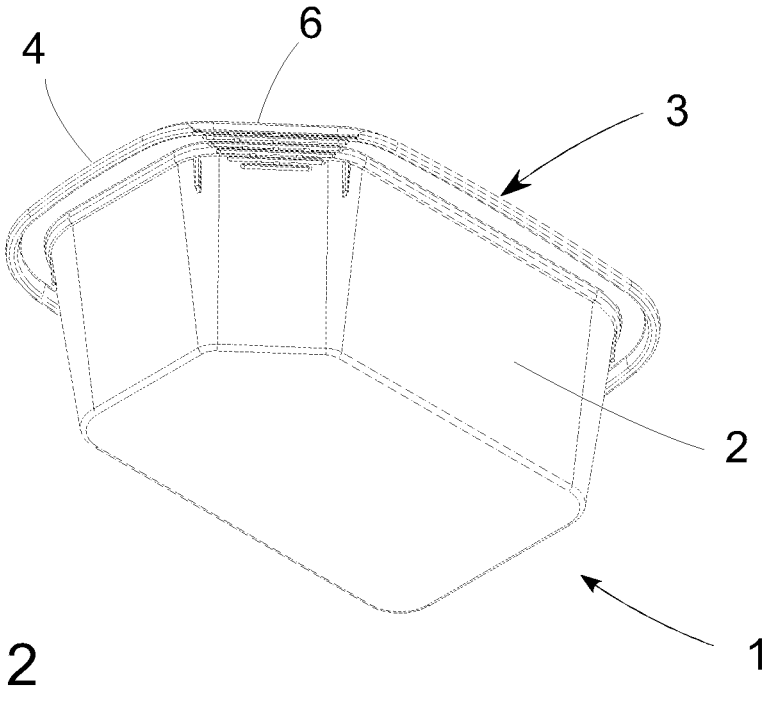
FIG. 2 is a perspective view of the packaging in FIG. 1, seen from below.
Figure 3:
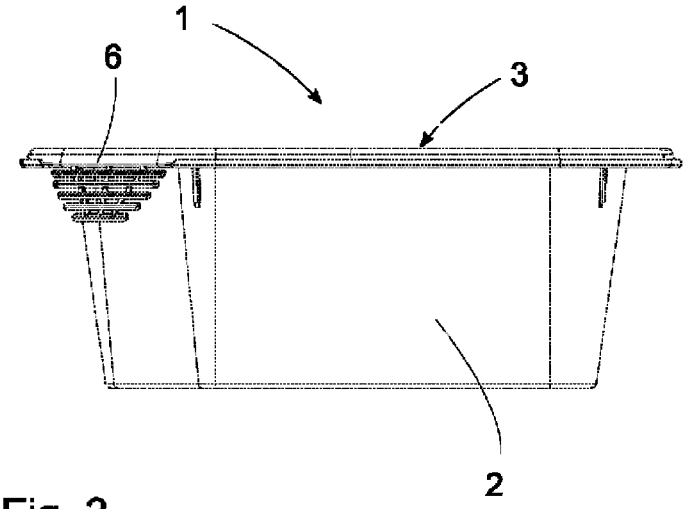
FIG. 3 is side view of the packaging in FIG. 1.
Figure 4:
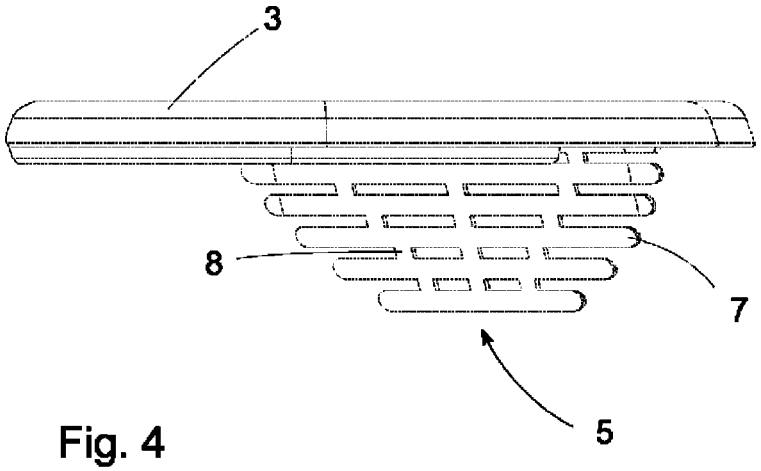
FIG. 4 is a side view showing a detail of a lid of the packaging in FIG. 1.

FIG. 4 shows a detail of the lid 3 seen from the side, whereby the lower side of the pull tab 5 is visible. As it may be seen, the bars 7 and the separate ribs 8 are flush at the lower side of the pull tab 5. As it may be seen in FIGS. 1 to 3, on the top side of the pull tab 5, the separate ribs 8 are lowered in relation to the bars 7. Consequently, the separate ribs 8 are rather flexible as compared to the bars 7, thereby facilitating bending of the pull tab 5 about an axis parallel to the bars.

The lid may be made with a sealing zone for joining directly with the container. The container 2 may have any suitable form, such as round, oval, square or rectangular. Its cross-section may be tapering in downward direction.

The invention claimed is:

1. A packaging comprising:

a container, a lid that can be sealed to the container, and a pull tab for facilitating removal of the lid from the container, said lid and pull tab being injection moulded and one piece, wherein the pull tab comprises a flexible flap that is bendable to a substantially upright position and consisting of a plurality of spaced, parallel and interconnected bars that extend in a direction substantially at right angles to a direction of pulling of the pull tab, adjacent bars being interconnected by at least two separate ribs that are thinner than the bars in a direction normal to a plane of the pull tab.

2. The packaging according to claim 1, wherein the lid includes a beveled corner, and the pull tab is connected to said beveled corner.

3. The packaging according to claim 1, wherein the pull tab, in its relaxed state, forms an angle of approximately 45 degrees with a general plane of the lid.

4. The packaging according to claim 1, wherein a length of the bars decreases with an increasing distance of the respective bars from the lid.

5. The packaging according to claim 1, wherein the lid comprises a sealing zone for joining directly with the container.

6. The packaging according to claim 1, wherein the pull tab includes three separate ribs interconnecting adjacent bars.

7. The packaging according to claim 1, wherein the pull tab includes at least two separate ribs connecting an innermost rib with an adjacent edge of the lid.

8. The packaging according to claim 1, wherein said pull tab consists of five bars and three separate ribs interconnected between adjacent bars.

* * * * *